US005652595A

United States Patent [19]

Ahrens et al.

[11] Patent Number: 5,652,595

[45] Date of Patent: Jul. 29, 1997

[54] PATCH ANTENNA INCLUDING REACTIVE LOADING

[75] Inventors: Arthur R. Ahrens; Chung Tong, both of Boynton Beach, Fla.

[73] Assignee: Motorola, Inc., Schaumburg, Ill.

[21] Appl. No.: 434,737

[22] Filed: May 4, 1995

[51] Int. Cl.$^6$ ..... H01Q 1/38

[52] U.S. Cl. ..... 343/700 MS; 343/702; 343/846

[58] Field of Search ..... 343/700 MS, 702, 343/846, 848, 600; H01Q 1/38

[56] References Cited

U.S. PATENT DOCUMENTS

| | | | |
|---|---|---|---|
| 4,379,296 | 4/1983 | Farrar et al. | 343/700 MS |
| 4,590,478 | 5/1986 | Powers et al. | 343/700 MS |
| 5,003,318 | 3/1991 | Berneking et al. | 343/700 MS |
| 5,227,749 | 7/1993 | Ragmenet et al. | 343/700 MS |
| 5,483,246 | 1/1996 | Barnett et al. | 343/700 MS |

FOREIGN PATENT DOCUMENTS

| | | | |
|---|---|---|---|
| 0215807 | 12/1983 | Japan | 343/700 MS |

*Primary Examiner*—Donald T. Hajec
*Assistant Examiner*—Tan Ho
*Attorney, Agent, or Firm*—Keith A. Chanroo

[57] ABSTRACT

An antenna (10) is set forth which may be used in, among other devices, a communications device, particularly a portable communications device. The antenna (10) includes a dielectric substrate (25) having first and second opposed sides. A ground plane (20) is disposed at the second side of the dielectric substrate and is in electrical contact therewith. An electrically conductive patch element (30) is supported by the first side of the dielectric substrate (25). The patch element (30) includes a feed point (40) at which RF energy is supplied to or received from the patch element (30). A plated aperture (70) is disposed through and electrically connected to the patch element (30) and extends into the dielectric substrate (25). The plated aperture (70) is electrically insulated from the ground plane (20) and offset from the feed point (40). The addition of the plated aperture (70) to the antenna (10) increases the electrical length of the antenna through reactive loading. The antenna thus resonates at a frequency that is lower than the same antenna configuration without the plated aperture.

24 Claims, 4 Drawing Sheets

150

206

PATCH ANTENNA INCLUDING REACTIVE LOADING

FIELD OF THE INVENTION

The present invention relates to an antenna, and more particularly to a patch antenna having a reactive loading structure for increasing the electrical length of the antenna without a corresponding increase in the physical length thereof.

BACKGROUND OF THE INVENTION

Antennas for communication devices, especially portable communications receivers, such as pagers, have generally been restricted to using electromagnetic loop antennas which optimize signal reception when the receivers are worn on the body. While loop antennas have performed satisfactorily for many years, the newer generations of personal portable communication devices are becoming ever smaller and their use is no longer limited to use on the body.

The size of communication devices has imposed strict space demands on the antennas capable of being utilized in such devices. To compensate for the decrease in available space, one known antenna interposes a dielectric core within a center fed loop antenna. The resulting antenna is responsive to both the magnetic and electric fields of an electromagnetic wave, thus improving the sensitivity of the antenna for a given size. It is also known to integrate a slot antenna into the communication device so that it forms a part of the housing where the slot antenna includes three plates arranged generally to have a U-shaped cross-section. A patch antenna has also been used in portable communications devices, a patch antenna being advantageous because of its generally low profile. Such patch antennas typically include (a) a thin flat metallic region typically called the patch; (b) a dielectric substrate; (c) a ground plane, which is usually much larger than the patch; and (d) a feed which supplies or receives the RF power.

The physical size of a patch antenna is determined by numerous factors. The principal factor that determines the antenna size is the frequency at which the antenna is to resonate. At higher operating frequencies, the patch antenna is small in size. The antenna's size, however, must be increased as the operating frequency is lowered. The patch antenna size is also influenced by other factors as well. For example, the electrical length of the patch is directly related to the dielectric constant of the dielectric substrate. A high dielectric constant substrate results in an antenna having an effective electrical length that is longer than the same antenna would have if the dielectric constant were lower. Another factor affecting the effective electrical length of the antenna is the ground plane. The smaller the effective size of the ground plane, the longer the patch element must be to operate properly at a given operating frequency. The effect of the ground plane on patch size is particularly noticeable in small portable communication devices where the space available for an adequate ground plane structure is limited. Although a dielectric substrate having a higher dielectric constant may be chosen to compensate for the less than optimal ground plane characteristics, such an approach tends to raise the Q factor of the antenna and, thus, decrease the operating bandwidth of the antenna. A narrow bandwidth may not be appropriate for many types of communications devices.

SUMMARY OF THE INVENTION

In accordance with the present invention, the disadvantages of prior antennas have been overcome. The antenna of the present invention is a patch antenna having a reactive loading structure that increases the effective electrical length of the antenna without a corresponding increase in physical size.

More particularly, the patch antenna in accordance with the present invention includes a feed point and a patch element disposed on a dielectric substrate. The effective electrical length of the antenna is increased by forming an aperture in the patch element and the substrate. The aperture is plated. The aperture plating is electrically connected to the patch element of the antenna at a point displaced from the feed point but is not grounded.

Other advantages and novel features of the present invention, as well as details of an illustrated embodiment thereof, will be more fully understood from the following description and drawings.

DESCRIPTION OF THE PREFERRED EMBODIMENT

Figure 1:
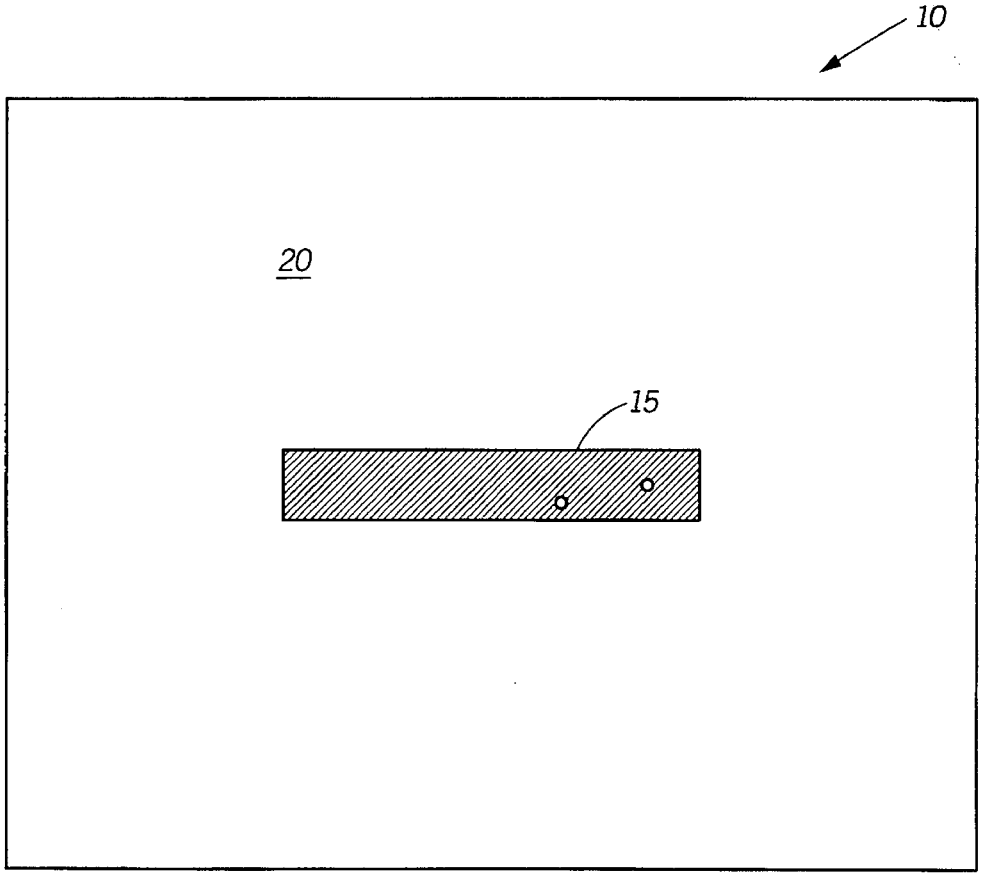
FIG. 1 is a plan view of a patch antenna system constructed in accordance with a preferred embodiment of the present invention.
Figure 2:
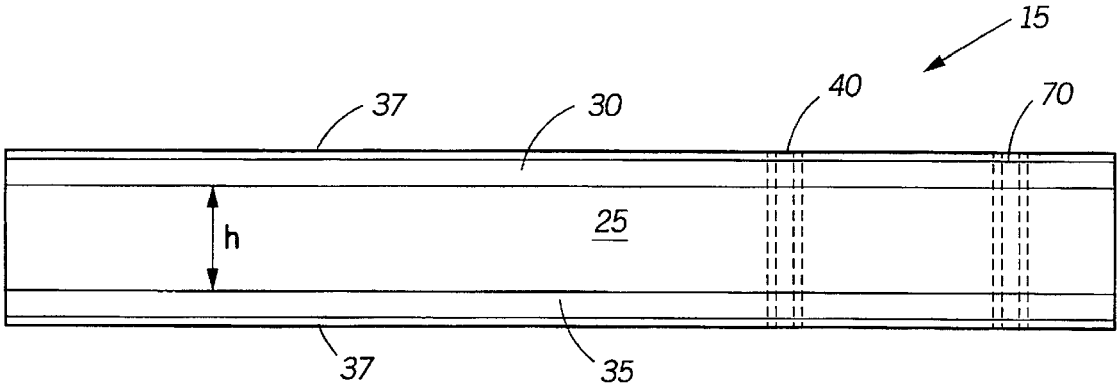
FIG. 2 is a side elevational view illustrating the various elements of the antenna element of the antenna of FIG. 1.

FIG. 1 is a plan view of a patch antenna system constructed in accordance with the preferred embodiment of the present invention. The patch antenna system 10, in accordance with one embodiment of the invention as shown generally in FIG. 1, includes an antenna element 15 which is electrically coupled to a ground plane 20. The antenna element 15, as shown in FIG. 2, includes a dielectric substrate 25 of thickness h which, for example, may be formed from TMM-10 temperature stable microwave material manufactured by Rogers Corporation of Chandler, Arizona. A first conductive plate 30 is disposed on a first side of the dielectric substrate 25 and functions as a patch radiating element while a second conductive plate 35 is disposed on a second side of the dielectric substrate 25 and functions as a grounding element.

Figure 3:
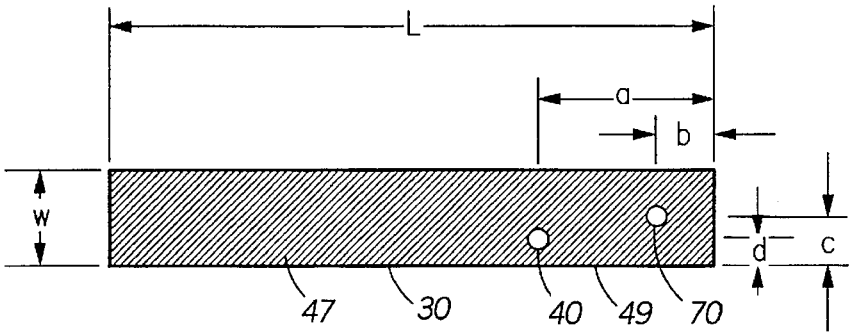
FIG. 3 is a top plan view of the antenna element of the patch antenna system of FIG. 1.
Figure 4:
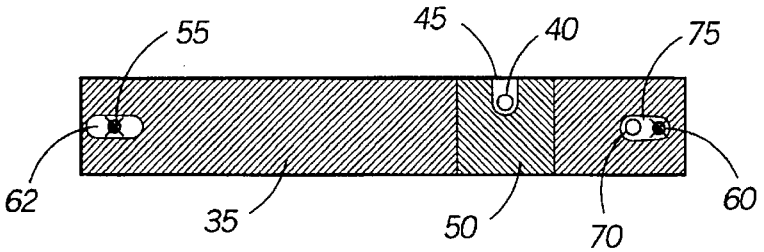
FIG. 4 is a bottom plan view of the antenna element of the patch antenna system of FIG. 1.

With reference to FIGS. 3 and 4, the antenna element has a length L and width W which are selected so that the antenna 10 receives or radiates as a half wave antenna at a given operating frequency. The first and second conductive plates 30 and 35 may include an insulating solder coating, designated at 37 of FIG. 2 and illustrated by the 45 degree cross-hatching in FIGS. 1, 3 and 4. Areas of exposed conductive material, for example, area 50, are illustrated by the 135 degree cross-hatching. In the areas of exposed conductive material, the solder mask has been removed.

Areas, such as areas 45 and 75, have had both the solder mask and conductive material removed and are illustrated without any cross-hatching. Known techniques are used to remove the solder mask and conductive material in these areas.

The antenna element 15 includes an antenna element feed 40 which, in the illustrated embodiment, is formed as a plated aperture through the first and second conductive plates 30 and 35. The antenna element feed 40 is electrically connected to the first conductive plate 30 but is electrically isolated from the bottom conductive plate 35 by area 45 in which the conductive material has been removed. Placement of the antenna element feed 40 is dependent on the desired input impedance of the antenna, for example, 50 ohms. In the illustrated embodiment, the antenna element feed 40 is displaced from the midpoint of the patch element 30 along length L and positionally divides the patch element into a first portion 47 and a second portion 49, the second portion 49 being shorter than the first portion 47.

The grounding element 35 is electrically connected to the ground plane 20 of FIG. 1 at areas 50, 55, and 60 in which the solder mask has been removed to expose the conducting material. Conducting lines 62 proceed from areas 55 and 60 to connect those areas to the plate 35.

Ideally, the ground plane 20 constitutes a perfect ground plane structure which is substantially larger than the antenna element 15. In communications devices, such as portable personal communication devices, the ground plane 20 is not made ideal due to the substantial space constraints imposed upon such devices. The size of the antenna element 15 using a non-ideal ground plane 20 at a given operating frequency must typically be increased over the size of an antenna element using an ideal ground plane which resonates at the same operating frequency. Such an increased size may preclude use of the patch antenna in a given application due to space constraints.

An alternative to increasing the physical size of the antenna element to compensate for a non-ideal ground plane is to use a dielectric substrate 25 having a high dielectric constant. An increase in the dielectric constant, however, tends to decrease the available bandwidth over which the antenna is optimally operational. The decreased bandwidth may again preclude use of the patch antenna system in various applications.

In accordance with the present invention, it has been found that the antenna system may be reactively loaded to increase the effective electrical length of the antenna element 15 without a corresponding increase in its physical size or an increase in the dielectric constant of the dielectric substrate 25. To increase the effective electrical length of the antenna, a plated aperture 70 extends through the first conductive plate 30 and into the dielectric substrate 25. The plating 72 of the aperture 70 is in electrical contact with the first conductive plate 30 but is isolated from the second conductive plate 35 by area 75 which has both the solder mask and conductive material removed. The degree of reactive loading is dependent on the placement of the plated aperture 70. A higher degree of reactive loading will result when the plated aperture is disposed at either end of the antenna element along length L. In the illustrated embodiment, the plated aperture 70 is disposed in section 49. It will be recognized, however, in view of the present teachings that the plated aperture may be disposed anywhere along length L or width W of the antenna element 15, including through section 47, depending on the desired loading characteristics.

In accordance with one particular embodiment of an antenna element 15 designed to resonate at 900 MHz, the antenna element may have the following dimensions:

L≈2.6 inches
W≈0.35 inches
h≈0.125 inches
a≈0.825 inches
b≈0.24 inches
c≈0.175 inches
d≈0.1 inches.

The antenna element may be formed from TMM-10 material having a 0.125 thickness. The dielectric substrate would then have a dielectric constant of about 10. The feed 40 and plated aperture 70 may each be 0.060 plated via apertures.

Other antenna configurations and materials are also suitable for use in the design of a patch antenna in accordance with the disclosed principles. The foregoing example is merely illustrative of one embodiment. For example, the plated aperture 70 may be disposed at any position dependent on the desired degree of reactive loading as discussed above. Additionally, insulating material having a lower dielectric constant and/or lower thickness may be used to increase the bandwidth of the antenna. Other variations are also possible dependent on the particular application of the antenna.

Figure 5:
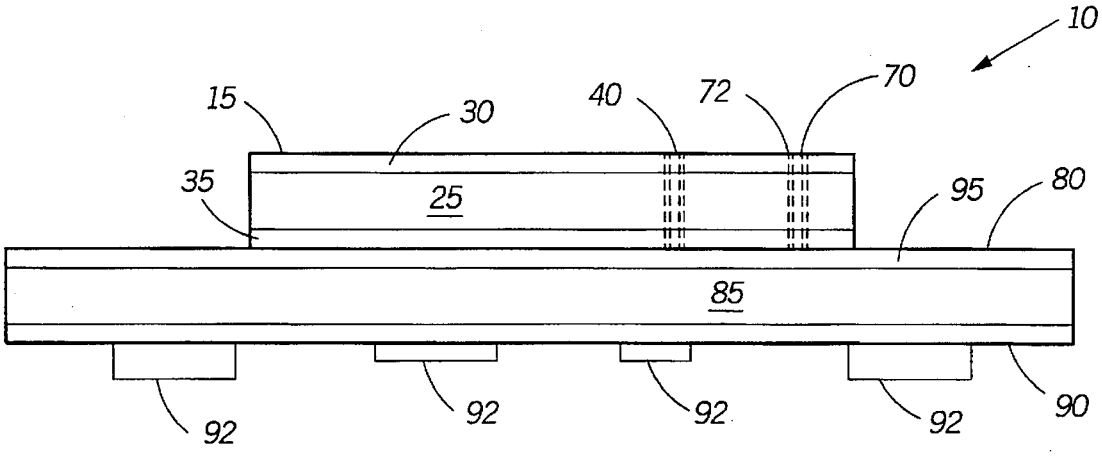
FIG. 5 is a side elevational view of the patch antenna system of FIG. 1 as mounted to a printed circuit board which, for example, may interconnect the various electrical components of a receiver and provide the ground plane for the antenna element.

FIG. 5 illustrates placement of the antenna element 15 on a printed circuit board, shown generally at 80. The printed circuit board includes a substrate 85 having a first metallization layer 90 which functions to interconnect the various components 92 of, for example, a portable communications device such as a paging transceiver, and a second metallization layer 95 which functions as the ground plane 20 of FIG. 1 as well as functioning as a ground plane for the components 92 of the communications device. The metallization layers 90 and 95 are selectively etched to provide the necessary interconnections required for operation of the antenna element 15 and components of the communications device.

As illustrated, the antenna element 15 is connected to the printed circuit board 80 at the side of the circuit board having the second metallization layer 95. More specifically, the metallization of the metallization layer 95 is selectively etched to provide an electrical connection between the second conductive layer 35 and the metallization layer 95 in areas 50, 55, and 60 while preventing a conductive connection between the metallization layer 95 and the antenna element feed 40 and plated aperture 70.

Figure 6:
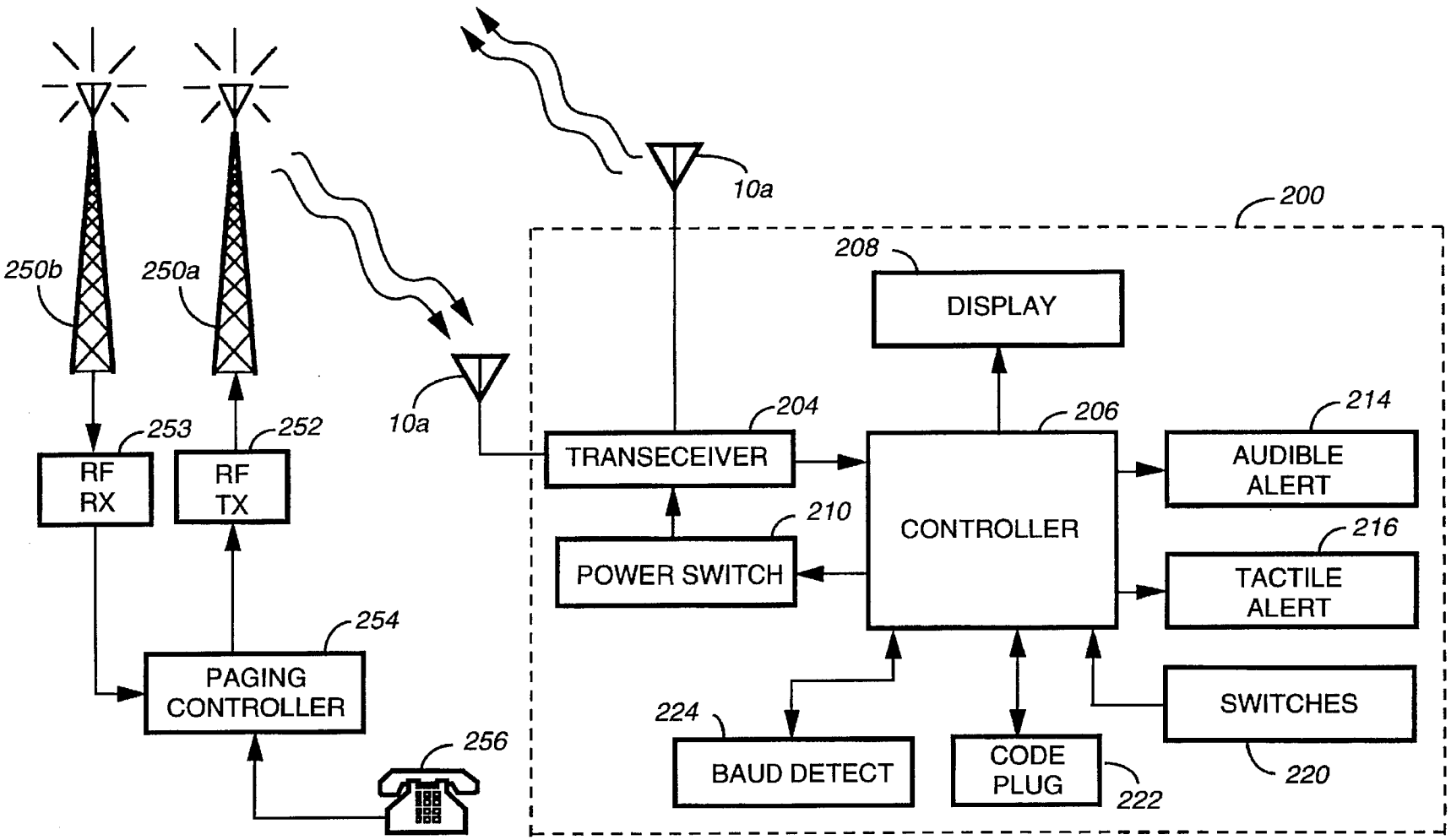
FIG. 6 is an electrical block diagram of a paging system including a paging receiver which may incorporate the patch antenna system of FIG. 1.

FIG. 6 is an electrical block diagram of a paging system 150 illustrating a paging transmitter/receiver and a selective call transceiver 200 which may use the patch antenna system of FIG. 1. The components of the selective call transceiver 200 are illustrated in an exemplary fashion in FIG. 5 at 92. These components are interconnected by traces formed by the conductive material of the metallization layer 90.

The paging transmitter 252 is coupled to an input device, for example, a telephone 256 for inputting messages or initiating pages via a paging terminal 254. The paging terminal 254 generates, e.g., pages to be transmitted to respective selective call transceivers 200. The paging controller 254 is coupled to the radio frequency transmitter for transmission of the pages or other messages via a transmission antenna 250*a*. Receiving, processing and transmitting selective call messages is known to one of ordinary skill in the art.

The transmissions are received by a selective call receiver 200 which includes transceiver 204, controller 206, display 208, power switch 210, audible alert 214, tactile alert 216, code plug 222, and baud detector 224. The electronic components forming these elements are represented by elements 92 of FIG. 5 which may, for example, constitute integrated circuits, resistors, capacitors, and other electronic components. Elements 92 are connected to one another by metallization layer 90 to form the selective call transceiver 200. Metallization layer 95 forms the ground plane for the elements 92.

The selective call transceiver 200 further comprises a first patch antenna system antenna 10*a* for intercepting transmitted radio frequency (RF) signals which are coupled to the input of the receiver portion of transceiver 204. The RF signals may be selective call (paging) message signals which provide, for example, a receiver address and an associated message, such as numeric, alphanumeric, or digital voice messages. However, it will be appreciated that other well known paging signaling formats, such as tone only signaling or tone and voice signaling, would be suitable for use as well. The transceiver 204 processes the RF signal and produces at the output a data stream representative of a demodulated data information. The demodulated data information is coupled into the input of a controller 206 which processes the information. A baud detector 224, coupled to the controller 206, is used to detect the baud rate of the received paging signal. A power switch 210, coupled to the controller 206, is used to control the supply of power to the transceiver 204.

When the address is received by the controller 206, the received address is compared with one or more addresses stored in a code plug (or code memory) 222, and when a match is detected, an alert signal is generated to alert a user that a selective call message or page has been received. The alert signal is directed to an audible alerting device 214 for generating an audible alert, such as a tone or voice message, or to a tactile alerting device 216 for generating a silent vibrating alert. Switches 220 allow the user of the selective call transceiver to, among other things, select between the audible alert 214 and the tactile alert 216 in a manner well known in the art.

The message information which is subsequently received is stored in memory 304 and can be accessed by the user for display or, for example, digital voice messaging, using one or more of the switches 220 which provide such additional functions as reset, read, and delete, etc. Specifically, by the use of appropriate functions provided by the switches 220, the stored message is recovered from memory and processed by the controller 206 for displaying by a display 208 which enables the user to view the message or for the playing of a received digital voice message.

Upon proper receipt of a paging transmission, the selective call transceiver 200 may respond with an RF transmission back to the paging terminal 254. In this respect, the transmitter portion of the transceiver 204 is modulated with digital data provided from the controller 206. The modulated RF is transmitted by a further patch antenna system 10*b* constructed in accordance with the teachings of the present invention and is received by a receiving antenna 250*b* and a receiver 253. The receiver 253 is connected to the paging terminal 254. The received data may include, for example, information on the location of the selective call transceiver 200. IF transmission and receipt of the RF signals between the paging terminal 254 and the selective call transceiver are at the same frequency, it may be possible to use only a single antenna at each location instead of the dual antennas that are illustrated here.

Figure 7:
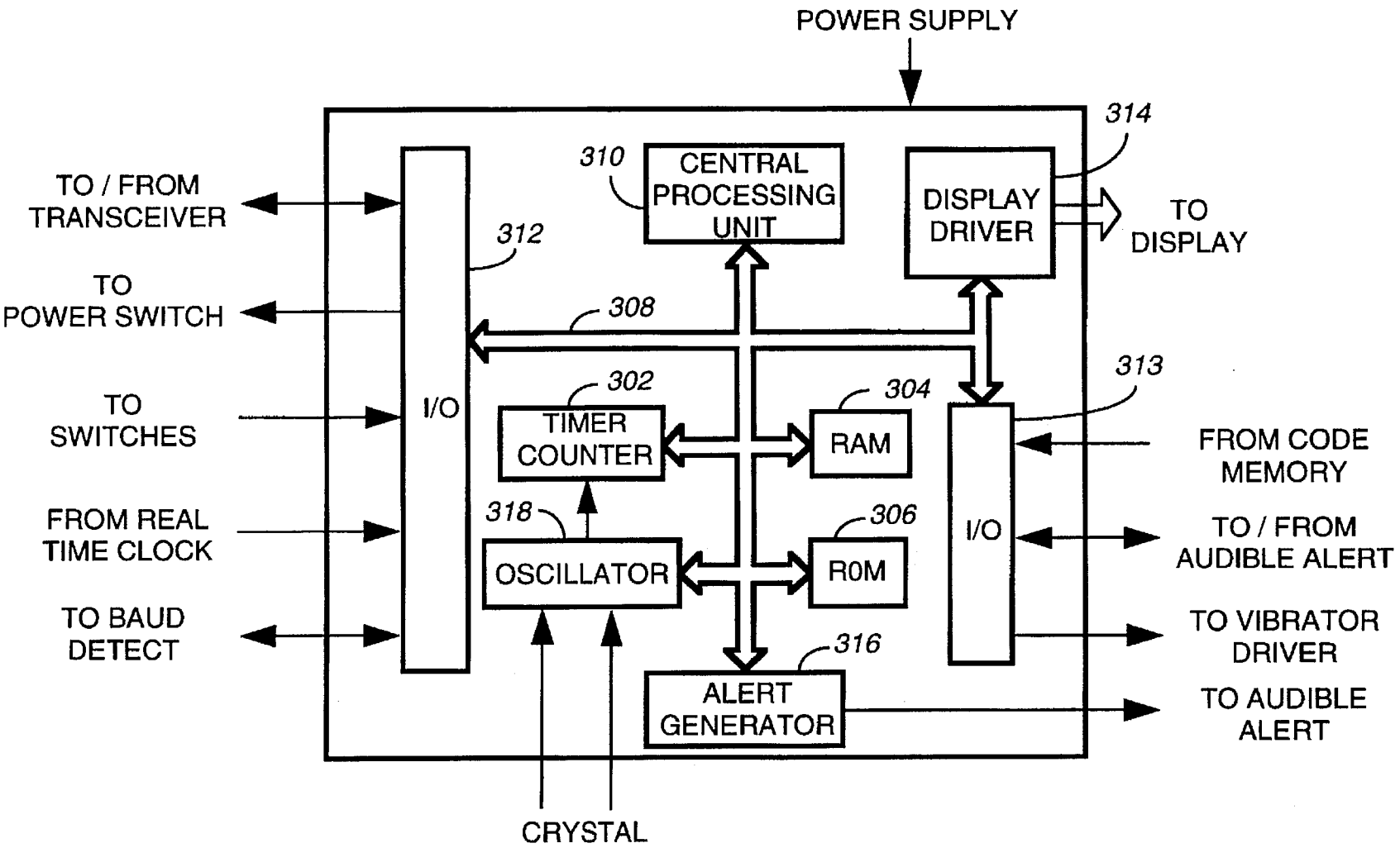
FIG. 7 is an electrical block diagram of the controller/decoder utilized in the system of FIG. 6.

FIG. 7 is an electrical block diagram of a microcomputer based decoder/controller suitable for use in the selective call receiver of FIG. 6. The controller 206 of FIG. 6 can be implemented utilizing a microcomputer as shown in FIG. 7 which, in turn, is interconnected by traces formed in metallization layers 90 and 95 of FIG. 5. As shown, the controller 206 is preferably of the MC68HC05 series microcomputers, such as manufactured by Motorola, Inc., which includes an on-board display driver 314. The controller 206 includes an oscillator 318 which generates the timing signals utilized in the operation of the controller 206. A crystal, or crystal oscillator (not shown), is coupled to the inputs of the oscillator 318 to provide a reference signal for establishing the microcomputer timing. A timer/counter 302 couples to the oscillator 318 and provides programmable timing functions which are utilized in controlling the operation of the receiver or the processor. A RAM (random access memory) 304 is utilized to store variables derived during processing, as well as to provide storage of message information which is received during operation as a selective call receiver. A ROM (read only memory) 306 stores the subroutines which control the operation of the receiver or the processor which will be discussed further. It will be appreciated that, in many microcomputer implementations, the programmable-ROM (PROM) memory area can be provided either by a programmable read only memory (PROM) or an EEPROM (electrically erasable programmable read only memory). The oscillator 318, timer/counter 302, RAM 304, and ROM 306 are coupled through an address/data/control bus 308 to a central processing unit (CPU) 310 which performs the instructions and controls the operations of the controller 206.

The demodulated data generated by the receiver is coupled into the controller 206 through an input/output (I/O) port 312. The demodulated data is processed by the CPU 310, and when the received address is the same as stored within the code-plug memory which couples into the microcomputer, through, for example, an I/O port 313, the message, if any, is received and stored in RAM 304. Recovery of the stored message and selection of the predetermined destination address are provided by the switches which are coupled to the I/O port 312. The controller 206 then recovers the stored message and directs the information over the data bus 308 to the display driver 314 which processes the information and formats the information for presentation by a display 208, such as an LCD (liquid crystal display). If a digital voice message is received and stored, the data can be accessed by the audible alert 214 which, for example, may include a digital voice synthesizer, through the I/O 313. At the time a selective call receiver's address is received, the alert signal is generated which can be routed through the data bus 308 to an alert generator 316 that generates the alert enable signal which is coupled to the audible alert device which may also include a tone generator. Alternatively, when the vibrator alert is selected, as described above, the controller generates an alert enable signal which is coupled through data bus 308 to the I/O port 313 to enable generation of a vibratory or silent alert.

The present patch antenna system has been described in the context of a paging transceiver. It will be recognized, however, that the presently disclosed antenna system can be used in other types of communications devices, including RF transmission devices, traditional paging systems, etc.

Although the present invention has been described with reference to a specific embodiment, those of skill in the art will recognize that changes may be made thereto without departing from the scope and spirit of the invention as set forth in the appended claims.

What is claimed is:

1. In a patch antenna having a feed point and a patch element disposed on a dielectric substrate, a method for increasing an electrical length of the patch antenna comprising the steps of:

forming a first aperture as the feed point displaced from a midpoint of the patch element comprising a first conductive plate and a second conductive plate disposed on opposite sides of the dielectric substrate and positionally dividing the patch element into first portion and second portion, the second portion being shorter than the first portion;

plating a second aperture to provide a plated aperture that is ungrounded at the second conductive plate;

electrically connecting the plated aperture to the first conductive plate of the patch antenna at a point displaced from the feed point for increasing the electrical length of the patch antenna.

2. The method for increasing the electrical length of the patch antenna as claimed in claim 1 wherein the electrical length of the patch antenna is a half wavelength at an operating frequency for which the patch antenna is to be used.

3. The method for increasing the electrical length of the patch antenna as claimed in claim 1 including electrically connecting the plated aperture to the patch element at a point in the second portion of the patch element.

4. An antenna comprising:

a dielectric substrate having first and second opposed sides;

a ground plane disposed at the second side of the dielectric substrate and in electrical contact therewith;

an electrically conductive patch element having a feed point, the electrically conductive patch element being supported by the first side of the dielectric substrate;

a first plated aperture as the feed point disposed through and electrically connected to the patch element positionally dividing the patch element into first portion and second portion, the second portion being shorter than the first portion, a second plated aperture extending into the dielectric substrate and, being electrically insulated from the ground plane and offset from the feed point for increasing the electrical length of the antenna.

5. An antenna as claimed in claim 4 wherein the dielectric constant of the dielectric substrate is less than or equal to ten.

6. An antenna as claimed in claim 4 wherein the plated aperture is disposed through the second portion of the patch element.

7. An antenna as claimed in claim 4 wherein the antenna resonates at about 901 MHz.

8. A portable communication device comprising:

a substrate having a first metallization layer, and at least a second metallization layer for establishing a receiver ground plane;

an antenna element including a dielectric substrate having a first conductive plate and a second conductive plate disposed on opposite sides thereof, the second conductive plate being electrically connected to the receiver ground plane, an antenna element feed disposed in the first conductive plate, and a plated aperture disposed in the dielectric substrate and through the first conductive plate at a position displaced from the antenna element feed, the plated aperture being electrically isolated from the receiver ground plane at the second conductive plate;

a transceiver interconnected by the first metallization layer and coupled to the antenna element feed.

9. A device as claimed in claim 8 wherein the transceiver provides means for receiving and demodulating address and message signals that are transmitted from a transmitter at a predetermined operational frequency and for transmitting data signals, the device further comprising:

a decoder, interconnected by the first metallization layer and coupled to the receiver, for decoding at least the address signals received by the receiver, and for generating an alert control signal in response to a match between the received address and a predetermined address; and an alert, interconnected by the first metallization layer and responsive to the alert control signal for alerting a user of a received message.

10. A device as claimed in claim 8 wherein a dielectric constant of the dielectric substrate is less than or equal to ten.

11. A device as claimed in claim 10 wherein the plated aperture is disposed through the second portion of the first conductive plate.

12. A device as claimed in claim 11 wherein the dielectric substrate, including the first and second conductive plates, have a length of about 2.6 inches and a width of about 0.35 inches.

13. A device as claimed in claim 12 wherein the plated aperture is disposed about 0.24 inches from a first end of the first conductive plate.

14. A patch antenna as claimed in claim 13 wherein the dielectric constant of the dielectric substrate is less than or equal to ten.

15. A patch antenna as claimed in claim 14 wherein the plated aperture is disposed through the second portion of the first conductive plate.

16. A patch antenna as claimed in claim 13 wherein the antenna element feed is disposed along a length of the first conductive plate and positionally divides the first conductive plate into first and second portions, the first portion of the first conductive plate being physically longer than the second portion of the first conductive plate.

17. A patch antenna as claimed in claim 13 wherein the patch antenna resonates at about 901 Mhz.

18. A device as claimed in claim 8 wherein the antenna element feed is disposed along a length of the first conductive plate and positionally divides the first conductive plate into first and second portions, the first portion of the first conductive plate being physically longer than the second portion of the first conductive plate.

19. A device as claimed in claim 8 wherein the antenna element resonates at about 901 Mhz.

20. A device as claimed in claim 19 wherein the antenna element feed is disposed about 0.825 inches from a first end of the first conductive plate.

21. A patch antenna for mounting to a printed circuit board having a ground plane, the antenna comprising:

a dielectric substrate having a first conductive plate and a second conductive plate disposed on opposite sides thereof, the second conductive plate having at least one uninsulated conducting portion disposed for electrical connection to the ground plane of the printed circuit board;

an antenna element feed disposed in the first conductive plate;

a plated aperture disposed through the dielectric substrate and the first conductive plate at a position displaced from the antenna element feed, the plated aperture being electrically isolated from the second conductive plate.

22. A portable communication device comprising:

a substrate having a first metallization layer, and at least a second metallization layer for establishing a receiver ground plane;

an antenna element including a dielectric substrate having a first conductive plate and a second conductive plate disposed on opposite sides thereof, the second conductive plate being electrically connected to the receiver ground plane, an antenna element feed disposed in the first conductive plate, and a plated aperture disposed in the dielectric substrate and through the first conductive plate at a position displaced from the antenna element feed, the plated aperture being electrically isolated from the receiver ground plane at the second conductive plate;

a receiver interconnected by the first metallization layer and coupled to the antenna element feed.

23. A device as claimed in claim 22 wherein the receiver provides means for receiving and demodulating address and message signals that are transmitted from a transmitter at a predetermined operational frequency and for transmitting data signals, the device further comprising:

a decoder, interconnected by the first metallization layer and coupled to the receiver, for decoding at least the address signals received by the receiver, and for generating an alert control signal in response to a match between the received address and a predetermined address; and an alert, interconnected by the first metallization layer and responsive to the alert control signal for alerting a user of a received message.

24. A portable communication device comprising:

a substrate having a first metallization layer, and at least a second metallization layer for establishing a receiver ground plane;

an antenna element including a dielectric substrate having a first conductive plate and a second conductive plate disposed on opposite sides thereof, the second conductive plate being electrically connected to the receiver ground plane, an antenna element feed disposed in the first conductive plate, and a plated aperture disposed in the dielectric substrate and through the first conductive plate at a position displaced from the antenna element feed, the plated aperture being electrically isolated from the receiver ground plane at the second conductive plate;

a transmitter interconnected by the first metallization layer and coupled to the antenna element feed.

* * * * *